US005307125A

United States Patent [19]

Knott

[11] Patent Number: 5,307,125

[45] Date of Patent: Apr. 26, 1994

[54] DEVELOPMENT STATION FOR AN ELECTROPHOTOGRAPHIC PRINTING OR COPYING STATION HAVING A MEANS FOR PREVENTING THE DISCHARGE OF THE MIXTURE

[75] Inventor: Josef Knott, Tutzing, Fed. Rep. of Germany

[73] Assignee: Siemens Aktiengesellschaft, Munich, Fed. Rep. of Germany

[21] Appl. No.: 954,938

[22] Filed: Sep. 30, 1992

Related U.S. Application Data

[63] Continuation of Ser. No. 576,407, Aug. 31, 1990, abandoned.

[51] Int. Cl.[5] ..... G03G 15/09

[52] U.S. Cl. ..... 355/251; 118/657

[58] Field of Search ..... 355/215, 251, 253; 118/657, 658

[56] References Cited

U.S. PATENT DOCUMENTS

| | | | |
|---|---|---|---|
| 3,754,526 | 8/1973 | Caudill | 355/253 X |
| 3,981,271 | 9/1976 | Okada et al. | 118/658 |
| 3,982,498 | 9/1976 | Wilcox | 355/253 X |
| 4,067,296 | 1/1978 | Sessink | 118/658 |
| 4,246,867 | 1/1981 | Hudson | 118/658 X |
| 4,292,922 | 10/1981 | Yamazaki et al. | 118/657 |
| 4,297,969 | 11/1981 | Torigai | 118/658 X |
| 4,300,475 | 11/1981 | Bond | 118/657 |
| 4,373,468 | 2/1983 | Suda et al. | 118/658 |
| 4,460,266 | 7/1984 | Kopp et al. | 355/253 |

FOREIGN PATENT DOCUMENTS 3006742 9/1990 Fed. Rep. of Germany .

OTHER PUBLICATIONS

Japanese Patent Abstract, vol. 11, No. 68 (P-553) [2515] Feb. 28, 1987 61-230176.

Japanese Patent Abstract, vol. 9, No. 163, (P-371) [1886] Jul. 9, 1985 60-41067.

Japanese Patent Abstract, vol. 8, No. 27, (P-252) [1464] Feb. 4, 1984 58-182662.

Japanese Patent Abstract, vol. 5, No. 88 (P-65) [760] Jun. 9, 1981 56-35157 (A).

Japanese Patent Abstract, vol. 6, No. 100 (P-121) [978] Jun. 9, 1982.

*Primary Examiner*—Fred L. Braun

*Attorney, Agent, or Firm*—Hill, Steadman & Simpson

[57] ABSTRACT

In an electrophotographic printer or copier, a hollow, rotatable development drum carries a carpet mixture including toner from a toner delivery region through a conveying region to a charge image carrier such as a photoconductive drum, through the action of elongated magnets mounted within the development drum which attract the toner mixture to the outer surface of the drum. The development drum is separated from the charge image carrier by a development gap at which the toner mixture is transferred to the charge image carrier to develop the electrostatic image thereon. Non-uniform, stray magnetic fields are present at the ends of the magnets, which attracts a non-uniform layer of the toner mixture, resulting in poor print quality. The non-uniform distribution of toner mix in the non-uniform magnetic fields at the ends of the magnets is prevented, in one embodiment, by limiting elements that prevent the toner from reaching the non-uniform fields ends of the development drum at the toner conveying region but which widen from the conveying region to the development gap. Another embodiment includes a shorter magnet at the conveying region and a longer magnet at the development gap.

6 Claims, 2 Drawing Sheets

Figure 1:
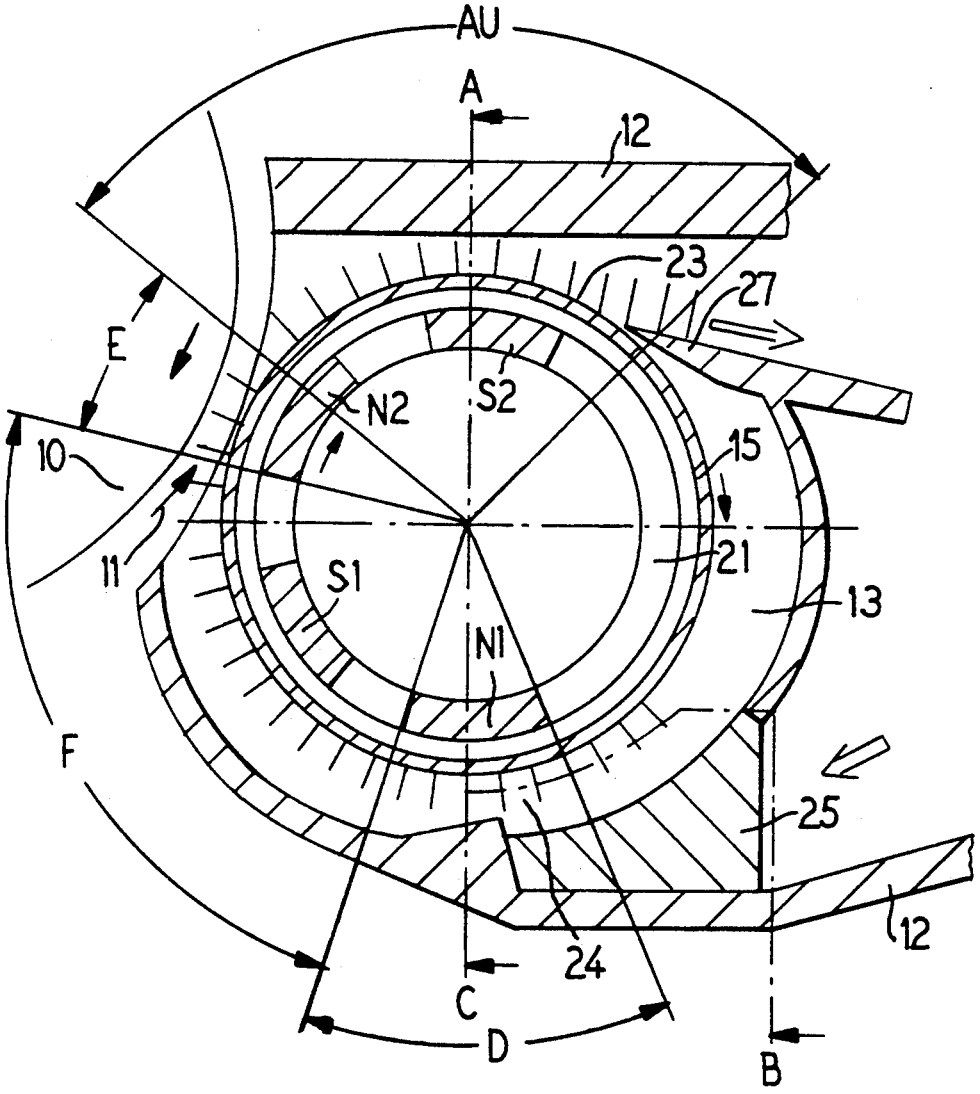

DEVELOPMENT STATION FOR AN ELECTROPHOTOGRAPHIC PRINTING OR COPYING STATION HAVING A MEANS FOR PREVENTING THE DISCHARGE OF THE MIXTURE

This is a continuation of U.S. application Ser. No. 576,407, filed Aug. 31, 1990, now abandoned.

The invention is directed to a development station for an electrophotographic printing or copying station having a motor-driven development drum, arranged in a station housing for conveying a developer mix carpet in a conveying region from a toner delivery region to a development gap; excess, unused developer being conveyed back into the development station from the development gap along an outlet region.

In copier technology and in non-mechanical, fast data printers that operate on the principle of electrophotography, charge images are generated on a charge image carrier, for example on a photoconductive drum or on a photoconductive band or directly on special paper, and are subsequently inked with a black powder (toner) in a development station. Given employment of a photoconductive drum, the toner image is subsequently transferred onto normal paper and is fixed thereon. As a rule, a two-component developer is employed for development, this being composed of ferromagnetic carrier particles and of toner particles. This development mixture or mix referred to below as "toner", is transported out of a reservoir of the development station with the assistance of what is referred to as a magnetic brush arrangement, being transported to the charge image on the charge image carrier and being conducted past the charge image carrier. The toner particles are then transferred to the charge image carrier on the basis of electrostatic forces and remain adhering there in character-dependent fashion.

For example, German patent 31 17 238 discloses such a magnetic brush arrangement. It is composed of a rotating hollow cylinder and of a magnet arrangement arranged in the inside of the hollow cylinder. The individual magnets of the magnet arrangement are secured on a carrier. They have alternating polarity in the moving direction of the hollow cylinder and thus initiate the transport of the development mixture on the hollow cylinder from the reservoir to the charge image carrier.

The individual magnets thereby have the shape of a ledge. They are uniformly magnetized over their length and generate a uniform magnetic field over their length that emerges perpendicularly from the hollow cylinder. Due to the edge, this field becomes non-uniform in the edge regions of the magnet ledge in the environment of the side edges of the magnet ledges and assumes the character of a stray field.

In development stations having development drums of the foregoing type, a discharge of mixture development can occur at the edge regions of the development drum. This so-called mixture discharge is composed of a passage of developer mixture beyond the surface of the development drum. i.e., the carpet of mixture situated on the surface of the development drum spreads in a disturbing fashion.

This local discharge of mixture can lead to considerable malfunctions in the printer operation due to mixture, voids in the print image and damage to the photoconductive drum.

It has now proven that this excessively broad mixture occurs in the delivery region of the developer mixture of the development station in what is referred to as the metering region upon passage of the developer mixture between development drum and metering ledge. The non-uniform magnetic field at the edges of the magnet ledges has proven the cause of this excessively broad mix carpet.

The mix discharge has an especially disturbing effect in the region of the development gap. Mix discharge must be avoided in this region in all cases because this has a direct influence on the inking quality and, thus, on the print quality of the photoconductive drum.

In order to avoid the mix discharge, U.S. Pat. No. 3,754,526 discloses that the axial lengths of the magnetic ledges preceding the development gap as seen in moving direction of the development drum be made shorter than the axial length of the magnetic ledges in the development gap.

Further, U.S. Pat. No. 4,246,867 discloses a development station in an electrophotographic printing means wherein the width of the mix carpet on the development drums is controlled via the length of the magnetic ledges.

Mechanical limiting elements for constricting the carpet of developer mix are disclosed by Japanese Patent Application 230176 (Abstract) and Japanese Patent Application 60-41067. (Abstract). JP-A-60-41067 thereby discloses the employment of non-magnetic baffle elements for the formation of a metering gap whose gap length is shorter than the magnetic ledge of the development drum that follows in the toner conveying direction.

It is an object of the invention to fashion a development station of the foregoing type in such fashion that, proceeding from a metering region, a developer mix is supplied such to the development gap that a uniform distribution of the mix carpet without mix discharge derives in the region of the development gap.

In a development station of this type, this object is achieved by the development drum containing a driven, hollow drum having permanent magnet ledges arranged axially therein with a uniform magnetic field region extending over their length and a non-uniform region at their longitudinal edges; and magnetic ledges allocated to the conveying region being fashioned shortened with reference to the magnetic ledges allocated to the development gap and to the toner delivery region, so that a construction in the width of the developer mix carpet is effected in the conveying region such that the developer mix carpet in the development gap only extends over the width of the uniform magnetic field region of the magnetic field ledges located there. Alternately, the objects are achieved by a development drum containing a driven, hollow drum having permanent magnet ledges arranged axially therein with a uniform magnetic field region extending over their length and a non-uniform region at their longitudinal edges; and limiting elements arranged at both sides of the development drum in the station housing, said limiting elements extending proceeding from the toner delivery region up to the development region over the circumference of the development drum and forming a guide channel for the developer mix carpet that broadens from the toner delivery region up to the development region such that the developer mix carpet in the development gap extends only over the width of the uniform magnetic field region of the magnetic ledges located there. Advantageous embodiments of the invention include the limiting elements being fashioned as formed portions of the station housing; or, alternately, the toner delivery region including a metering gap whose gap length is shorter than the magnetic ledge acting following in a conveying direction of the mix carpet.

The mix carpet is guided such in the conveying region that, with reference to the magnetic ledges effective in the development gap, it comprises a width in the development gap that extends over the width of the uniform magnetic field region of the magnetic ledges, excluding the non-uniform magnetic field region.

This is achieved by mechanical baffle or limiting elements that, in an advantageous embodiment, are composed of side elements of the development station housing that, proceeding from the delivery region of the developer mix that is referred to in short as "toner delivery region", extend up to the development gap over the circumference of the development drum and form a guide channel for the mix carpet that broadens from the toner delivery region to the development gap.

Further, the magnetic ledges in the conveying region can be fashioned shortened such that a constriction in the width of the mix carpet ensues between the toner delivery region and the development.

It is thereby only necessary to shorten the magnetic ledge in the conveying region. This simple measure by itself prevents a mix discharge in the development gap region.

In the following, the term "magnetic ledge" shall be employed for magnetized regions in the development drum. These magnetized regions can be uninterrupted ledges; however, they can also be composed of magnetized sub-surfaces of a magnetic hollow drum or can be composed of individual bar magnets. What is thereby critical is their uniform magnetic field along the axial extent of the magnetic ledges and their field line course perpendicular to the hollow drum of the development station. The term "magnetic ledge" is used for all of these instances.

Figure 2:
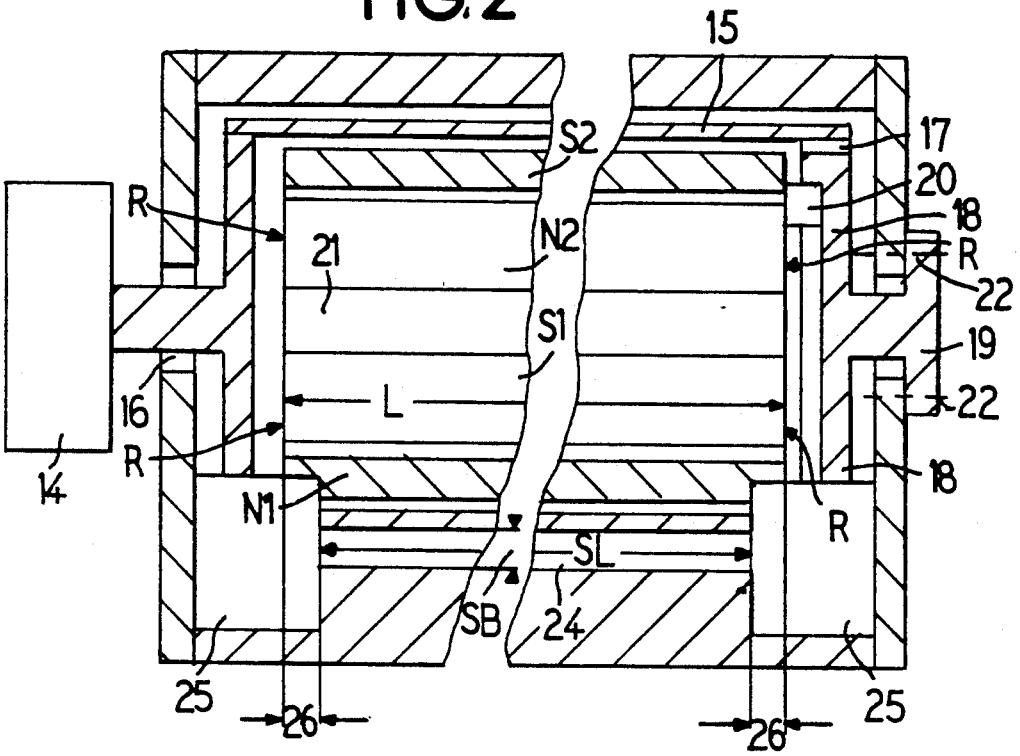
Figure 3:
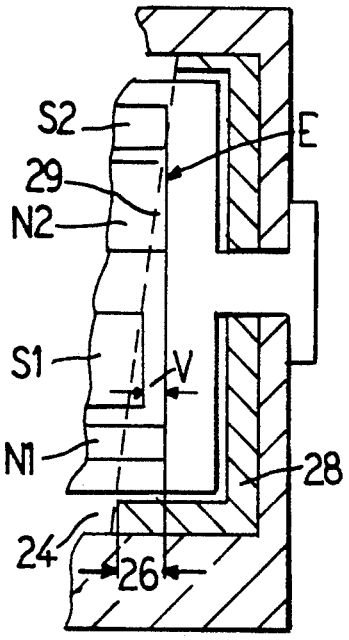

Embodiments of the invention are shown in the drawings and shall be set forth in greater detail below by of example. Shown are:

FIG. 1 a schematic sectional view of the development region of an electrophotographic printing means;

FIG. 2 a schematic longitudinal section of the development region of FIG. 1 along the section line AB; and FIG. 3 a schematic sectional view of an embodiment having an illustration corresponding to the section line AC of FIG. 1.

In an electrophotographic printing means that is not shown in detail here, a charge image is generated on a photoconductive drum 10 with a character generator in a known fashion. This charge image is inked in a development gap 11 with the assistance of the development station shown in FIG. 1. The development station is composed of an actual, shape-stable station housing 12 having a development drum 13 rotatably seated therein that is driven via a motor 14. Instead of the motor 14, it is also possible to connect the development, drum 13 to a central printer drive via a gearing arrangement. The development drum 13 contains a hollow drum of aluminum 15; it is seated at one side at a housing part via bearings 16. It has its other end guided on a supporting sheave 18 via a bearing 17. The supporting sheave 18 is secured in the station housing radially adjustable via an adjustment means 19; via retaining elements 20, it carries a magnetized hollow drum 21 having a plurality of magnetic ledges N1, S1, N2, S2 arranged thereon. In the illustrated case, these magnetic ledges represent magnetized regions of the hollow drum 21. Instead of the magnetized regions of the magnetic hollow drum 21, it is also possible to arrange individual magnetic ledges on the hollow drum or similar supporting means.

The magnetic ledges over the magnetic hollow drum can be adjusted in their relative, radial position VIS-A-VIS to the hollow drum 15 of the development drum with the adjustment means 19 in combination with lock screws 22 arranged in oblong holes. For example, the position of the magnetic ledge N2 effective in the region of the development gap can thus be changed and the mix application in the development gap 11 can thus be influenced.

The magnetic ledges N1, S1, N2, S2 are composed of uniformly magnetized regions that have a uniform magnetization over the entire length L. The emerging, magnetic field lines have a non-uniform distribution at the edges R.

The magnetic ledges N, S are arranged on the magnetic drum 21 parallel to the hollow drum 15. When, as in the illustrated exemplary embodiment, four magnetic ledges are employed, then the first magnetic ledge N1 (magnetic North Pole) is allocated to the toner delivery region (metering region) D and the following magnetic ledge S (magnetic South Pole) is allocated to the conveying region F. This conveying region F is followed by the actual development zone E having the magnetic ledge N2, what is referred to as the inking magnet (magnetic North Pole). The development zone E is followed by an outlet region AU having a magnetic ledge S2 (magnetic South Pole).

The magnetic ledges N,S generate a magnetic field that resides perpendicularly on the hollow drum 15 of aluminum, this resulting in a brush-like fashioning of the developer mix carpet 23 of ferromagnetic carrier particles having toner particles agglomerated thereto.

Function of the development station:

Proceeding from a toner reservoir (not shown here), developer mix is supplied to a metering region D (toner delivery region) in the arrow direction illustrated in FIG. 1. The metering region contains a metering gap 24 that is laterally limited by two limiting elements 28 of plastic. These limiting elements 28 are composed of plastic and can also be fashioned as part of the sidewalls of the station housing 12. The limiting elements 28 are arranged at both sides of the development drum and their edges 29 form a guide channel for the mix carpet that extends from the toner delivery region up to the development gap over the circumference of the development drum and that gradually broadens from the metering gap 24 up to the development region E in accord with the edge course of FIG. 2.

This widening can ensue continuously as in the illustrated exemplary embodiment; however, it can also be stepped, so that the mix carpet enlarges step-by-step.

The metering gap width SM between development drum (hollow drum 15) and station housing depends on the required metered quantity of toner and, thus, on the printer performance. The gap length SL is in turn dependent on the width of the development gap. The development gap itself has a length that is somewhat shorter than the length L of the magnetic ledges. As a result thereof, a mix carpet of developer mix is produced in the region of the development gap 11, this mix carpet having approximately the width of the magnetic ledge length L.

As already stated, the metering gap is laterally limited by limiting elements 28. The metering gap length SL thus becomes shorter than the length L of the magnetic ledges. An overlap region 26 of 0.1 through 10 mm, preferably 2–5 mm, arises. This overlap of the length of the magnetic ledges L with the limiting elements 28 reduces the width of the mix carpet in the toner delivery region D. The edges of the mix carpet thus lie within the uniform region of the magnetic fields of the development drums.

During transport of the developer mix from the delivery region for the developer mix referred to as toner delivery region D over the conveying region F to the development region E, the carpet of developer mix gradually broadens until it has a width on the hollow drum 15 in the development gap that approximately corresponds to the length of the magnetic ledge N2.

The mix carpet is thus situated in the uniform region of the magnetic ledge N2 and a lateral mix discharge at the edges R cannot occur.

After the inking of the charge image in the development region E, the mix carpet that has not been used is returned into the development station with the assistance of the hollow drum 15 moving in arrow direction. To this end, a scraper element 27 is provided that lifts the mix carpet off from the development drum 13 and resupplies it to the toner delivery region via mixing stages (not shown here).

The mix discharge can also be prevented by designational guidance of the mix carpet by adapting the lengths of the magnetic ledges. In the embodiment shown in FIG. 3, the conveyor magnetic ledge S1 effective in the conveying region F is shorter by 1–5 mm at both sides than the magnetic ledges N1, or respectively, N2 that are arranged preceding and following it. The shortening V of the conveying magnetic ledge S1 effects a narrowing of the mix carpet during transport in this region F, i.e. a constriction of the mix carpet. Since the magnetic field at the inking magnet N2 (development gap 11) extends farther in an outward direction than the uniform magnetic field region of the conveying magnetic ledge S1, the edges of the mix carpet in the region of the development gap 11 are situated in the uniform magnetic field region and a discharge of mix over the edges thereof does not occur.

In an exemplary embodiment that is not shown here, the pick-up magnet N1 in the region of the metering means is reduced in length by 1–10 mm, preferably by 2–5 mm, in comparison to the following magnetic ledges S1. Upon transfer of the mix carpet from the metering region D into the conveying region F, it is thus guaranteed that the etches of the mix carpet lie in the region of the uniform fields of the magnetic ledges of the conveying region F and, thus, of the development region E as well. A discharge of mix is thus also prevented with this measure.

The same effect as achieved by shortening the magnets N1 or, respectively, S1, can be achieved by a lengthening of the inking magnet N2, i.e. of the magnet effective in the development gap, by a defined dimension of 1–10 mm or, respectively, 2–5 mm at both sides with reference to the length of the magnetic ledge S1 lying in the conveying region F.

Analogous to the course of the edge 22 of the limiting element 28 in FIG. 3, it is also possible to adapt the lengths of the individual magnetic ledges to one another such that a continuous or step-by-step increase in length of the successive magnets by 0.2 through 2.5 mm, preferably 0.2–1 mm, derives along the circumference of the development drum 13 from the metering gap 24 up to the development zone E.

It is also possible to combine the length variation on of the magnetic ledges with correspondingly fashioned baffle elements.

Although other modifications and changes may be suggested by those skilled in the art, it is the intention of the inventors to embody within the patent warranted hereon all changes and modifications as reasonably and properly come within the scope of their contribution to the art.

I claim:

1. A development station for applying toner from a toner delivery region to a charge image carrier of an electrophotographic printing or copying apparatus, comprising:

a development drum mounted so that an outer surface thereof lies adjacent the charge image carrier to define a development gap between said development drum and the charge image carrier at a development region, said development drum having a portion thereof at the toner delivery region for receiving toner so that the toner is carried to the development region when said development drum is rotated being hollow;

means for rotating said development drum in said predetermined direction; and a plurality of elongated magnets mounted within said development drum extending generally in a direction of the axis of said development drum for attracting toner to said outer surface of said development drum, a first magnet of said plurality of magnets being mounted preceding the development region in the predetermined direction, a second magnet of the plurality of magnets being mounted generally at the development region for the transfer of the toner to the charge image carrier at the development gap, said first magnet being shorter than said second magnet and being mounted so that toner attracted to said outer surface by said first magnet at the toner delivery region is of a limited axial extent and so that the toner spreads in an axial direction as rotation of said development drum carries the toner to said development region to substantially prevent toner at the development gap from reaching non-uniform magnetic fields at ends of said second magnet.

2. A development station having a station housing for an electrophotographic printing or copying station, comprising the following features:

(a) a motor-driven development drum arranged in the station housing and being rotatable in a development direction to convey a developer mix carpet through a conveying region from a toner delivery region to a development gap;

(b) means for conveying excess, unused developer back into the development station from the development gap along an outlet region;

(c) a driven, hollow drum having permanent magnet ledges arranged axially therein contained within said development drum, said permanent magnet ledges each having a substantially uniform magnetic field region extending over a substantial portion of their length and a non-uniform magnetic field region at their respective longitudinal edges; and (d) at least a first one of said permanent magnetic ledges allocated to the conveying region being of a shorter extent and at least a second one of said permanent magnetic ledges allocated to the development gap being longer than said first ledges, so that a constricted width of the developer mix carpet is present as the developer mix is moved through the conveying region toward the development gap such that when the developer mix carpet is carried by said first ledges to said second ledges in the development gap said developer mix carpet only extends over a width of the uniform magnetic field region of the second magnetic field ledges located therein.

3. A development station according to claim 2, wherein the toner delivery region comprises a metering gap whose gap length is shorter than the magnetic ledge acting following in conveying direction of the mix carpet.

4. A development station for applying toner from a toner delivery region to a charge image carrier of an electrophotographic printing or copying apparatus, comprising:

a development drum mounted so that an outer surface thereof lies adjacent the charge image carrier to define a development ga between said development drum and the charge image carrier at a development region, said development drum having a portion thereof at the toner delivery region for receiving toner so that he toner is carried to the development region when said development drum is rotated about its axis in a predetermined direction, said development drum being hollow;

means for rotating said development drum in said predetermined direction;

a plurality of elongated magnets mounted within said development drum extending generally in a direction of the axis of said development drum, said plurality of magnets being positioned to cause toner to be carried on said outer surface of said development drum from the toner deliver region to the development region for transfer of the toner to the charge image carrier at the development gap when said development drum rotates in said predetermined direction; and limiting elements mounted adjacent said outer surface of said development drum to limit an axial extent of the toner at each end of said development drum preceding the development region in the predetermined direction, said limiting elements being spaced farther apart at the development region to permit the toner to spread axially outward as the toner is carried by rotation of the development drum to the development region.

5. A development station having a station housing for an electrophotographic printing or copying station, comprising the following features:

(a) a motor-driven development drum arranged in the station housing and being rotatable to convey a developer mix carpet in a conveying region from a toner delivery region to a development gap;

(b) means for conveying excess, unused developer back into the development station from the development gap along an outlet region;

(c) the development drum containing a driven, hollow drum having permanent magnet ledges arranged axially therein with a uniform magnetic field region extending over their length and a non-uniform region at their longitudinal edges; and (d) limiting elements arranged at both sides of the development drum in the station housing, said limiting elements extending proceeding from the toner delivery region up to the development region over the circumference of the development drum and forming a constricted guide channel for the developer mix carpet, said limiting elements being absent at the development region so that a broader guide channel is present at the development region relative to said constructed guide channel extending from the toner delivery region up to the development region such that the developer mix carpet in the development gap extends only over a width of a uniform magnetic field region of the magnetic ledges located at the development region.

6. A development station according to claim 5, wherein the limiting elements are portions of the station housing.

* * * * *